US009525237B2

(12) United States Patent
Aida

(10) Patent No.: US 9,525,237 B2
(45) Date of Patent: Dec. 20, 2016

(54) CONNECTOR

(71) Applicants: TOYOTA JIDOSHA KABUSHIKI KAISHA, Toyota-shi, Aichi (JP); KABUSHIKI KAISHA TOYOTA JIDOSHOKKI, Kariya-shi, Aichi (JP)

(72) Inventor: Tatsuya Aida, Kariya (JP)

(73) Assignees: KABUSHIKI KAISHA TOYOTA JIDOSHOKKI, Aichi (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 0 days.

(21) Appl. No.: 15/023,017

(22) PCT Filed: Sep. 2, 2014

(86) PCT No.: PCT/JP2014/073021

§ 371 (c)(1),
(2) Date: Mar. 18, 2016

(87) PCT Pub. No.: WO2015/041041

PCT Pub. Date: Mar. 26, 2015

(65) Prior Publication Data

US 2016/0233609 A1 Aug. 11, 2016

(30) Foreign Application Priority Data

Sep. 20, 2013 (JP) ..... 2013-195749

(51) Int. Cl.
*H01R 33/00* (2006.01)
*H01R 13/52* (2006.01)
(Continued)

(52) U.S. Cl.
CPC ..... *H01R 13/5213* (2013.01); *H01R 13/533* (2013.01); *H01R 13/5804* (2013.01); *H01R 13/6591* (2013.01); *H01R 2201/26* (2013.01)

(58) Field of Classification Search
CPC ..... H01R 13/5213; H01R 13/5804; H01R 13/6591; H01R 13/533; H01R 2201/26
(Continued)

(56) References Cited

U.S. PATENT DOCUMENTS 7,507,108 B2 * 3/2009 Tsuji ..... H01R 13/5841 439/446
7,686,630 B2 * 3/2010 Takehara ..... H01R 13/5213 439/140
(Continued)

FOREIGN PATENT DOCUMENTS

JP 2002-324627 A 11/2002
JP 2007-103044 A 4/2007
(Continued)

OTHER PUBLICATIONS

International Search Report dated Sep. 30, 2014, issued by the International Searching Authority in application No. PCT/JP2014/073021.
(Continued)

*Primary Examiner* — Khiem Nguyen
(74) *Attorney, Agent, or Firm* — Sughrue Mion, PLLC

(57) ABSTRACT

A connector configured to electrically connect an electric wire to a motor mounted on a vehicle, the connector including: a connector main body portion attached to one end portion of the electric wire, a bracket fixed to the motor in a state of holding the connector main body portion, and a cover placed over the bracket so as to cover the connector main body portion and fixed to the motor in a state of holding the electric wire.

5 Claims, 8 Drawing Sheets

(51) Int. Cl.
*H01R 13/58* (2006.01)
*H01R 13/6591* (2011.01)
*H01R 13/533* (2006.01)

(58) Field of Classification Search
USPC ..... 439/34, 449, 456, 460, 502, 503
See application file for complete search history.

(56) References Cited

U.S. PATENT DOCUMENTS

| | | | |
|---|---|---|---|
| 2002/0157843 | A1 | 10/2002 | Fukushima et al. |
| 2008/0188120 | A1 | 8/2008 | Tsuji |
| 2009/0311899 | A1 | 12/2009 | Takehara et al. |

FOREIGN PATENT DOCUMENTS

| | | | |
|---|---|---|---|
| JP | 2008-52918 | A | 3/2008 |
| JP | 2009-301856 | A | 12/2009 |
| JP | 2013-101760 | A | 5/2013 |

OTHER PUBLICATIONS

International Preliminary Report on Patentability and Written Opinion of the International Searching Authority dated Mar. 31, 2016, issued by the International Searching Authority in application No. PCT/JP2014/073021.
Communication dated Apr. 5, 2016 from Japanese Patent Office in counterpart Application No. 2013-195749.

* cited by examiner

CONNECTOR

CROSS REFERENCE TO RELATED APPLICATIONS

This application is a National Stage of International Application No. PCT/JP2014/073021 filed Sep. 2, 2014, claiming priority based on Japanese Patent Application No. 2013-195749 filed Sep. 20, 2013, the contents of all of which are incorporated herein by reference in their entirety.

TECHNICAL FIELD

An aspect of the present invention relates to a connector for connecting electric wires to a motor mounted on a vehicle.

BACKGROUND ART

Patent Literature 1 discloses a connector adopted in a wire harness that connects a motor for driving a hybrid vehicle and an inverter. The connector has a male side connector unit provided at one end portion of an electric wire of the wire harness. The male side connector unit is made up of three male terminals, a first main body portion configured to hold the three male terminals, and a first terminal housing unit con figured to house the male terminal and the first main body portion. The one end portion of the male terminal is connected to the electric wire via a female terminal. The other end portion of the male terminal is connected to a device side male terminal connected to the inverter side.

CITATION LIST

Patent Literature

Japanese Unexamined Patent Publication No. 2009-301856

SUMMARY OF INVENTION

Technical Problem

Incidentally, in the above-described connector, for example, due to a situation in which a mode of the vibration of the motor and a mode of vibration of the inverter are different from each other during travelling of a vehicle, repeated bending and stretching occur in the electric wires connected to both of them. In that case, the vibration occurs in the device side male terminal connected to the inverter (or motor) side, as a result, abrasion occurs in the device side male terminal and its receiving portion, and there is a risk of deterioration of reliability. Further, since the motor and the inverter are disposed outside a passenger compartment, the first main body portion holding the male terminal floods, and there is a risk of deterioration of reliability.

An aspect of the present invention has been made in view of such circumstances, and an object thereof is to provide a connector capable of improving reliability.

Solution to Problem

In order to solve the above problems, according to an aspect of the present invention, there is provided a connector configured to electrically connect an electric wire to a motor mounted on a vehicle, the connector including: a connector main body portion attached to one end portion of the electric wire; a bracket fixed to the motor in a state of holding the connector main body portion; and a cover placed over the bracket so as to cover the connector main body portion and fixed to the motor in a state of holding the electric wire.

In the connector, the connector main body portion is attached to one end portion of the electric wire and is held on the bracket. The bracket is fixed to the motor in the state of holding the connector main body portion. Further, the cover is placed over the bracket to cover the connector main body portion held by the bracket. Therefore, the connector main body portion is suppressed from flooding. Meanwhile, the cover is fixed to the motor in the state of holding the electric wire. Therefore, an occurrence of bending and stretching in the electric wire due to independent vibration of the motor and the electric wire is avoided. As described above, according to the connector, the reliability is improved.

In the connector according to an aspect of the present invention, the cover may be placed over the bracket so as to further cover a metallic braided wire fixed to the bracket so as to cover the electric wire. In this case, the braided wire covering the electric wire is covered with the cover. Therefore, it is possible to shield the noise from the motor by the braided wire, while suppressing rusting of the braided wire caused by flooding.

In the connector according to an aspect of the present invention, the cover may include a protective member holding portion configured to hold a protective member covering the electric wire, and an electric wire holding portion configured to hold the electric wire of a state of being exposed from the protective member. In this case, by fixing the cover to the motor, the electric wire is fixed to the motor, and the protective member covering the electric wire is also fixed to the motor. Therefore, it is possible to suppress an occurrence of abrasion on the electric wire and the protective member caused by the independent vibration of the protective member and the electric wire.

In the connector according to an aspect of the present invention, the bracket and the cover may be fixed to the motor by a common fixing member. In this case, upon an improvement in reliability, it is possible to simplify the structure and reduce the number of components.

In the connector according to an aspect of the present invention, the bracket includes a flat plate-like bracket base portion, and a holding portion provided to protrude from a bracket base portion in a predetermined direction and configured to hold the connector main body portion. The cover includes a cover base portion extending along the bracket base portion, a cover main body portion provided to protrude from the cover base portion in a predetermined direction and configured to cover the connector main body portion and the holding portion, and a side wall portion provided to protrude from an outer edge of the cover base portion in a direction opposite to the predetermined direction. The side wall portion may be located outside an outer surface of the bracket base portion, and may overlap the outer surface of the bracket base portion when viewed from a direction intersecting with the predetermined direction, in this case, the side wall portion protruding from the outer edge of the cover base portion overlaps the outer surface on the outside the outer surface of the bracket base portion. Therefore, it is possible to suppress the water from entering the bracket from the outer surface of the bracket base portion.

Advantageous Effects of Invention

According to an aspect of the present invention, it is possible to provide a connector capable of improving reliability.

DESCRIPTION OF EMBODIMENTS

Figure 1:
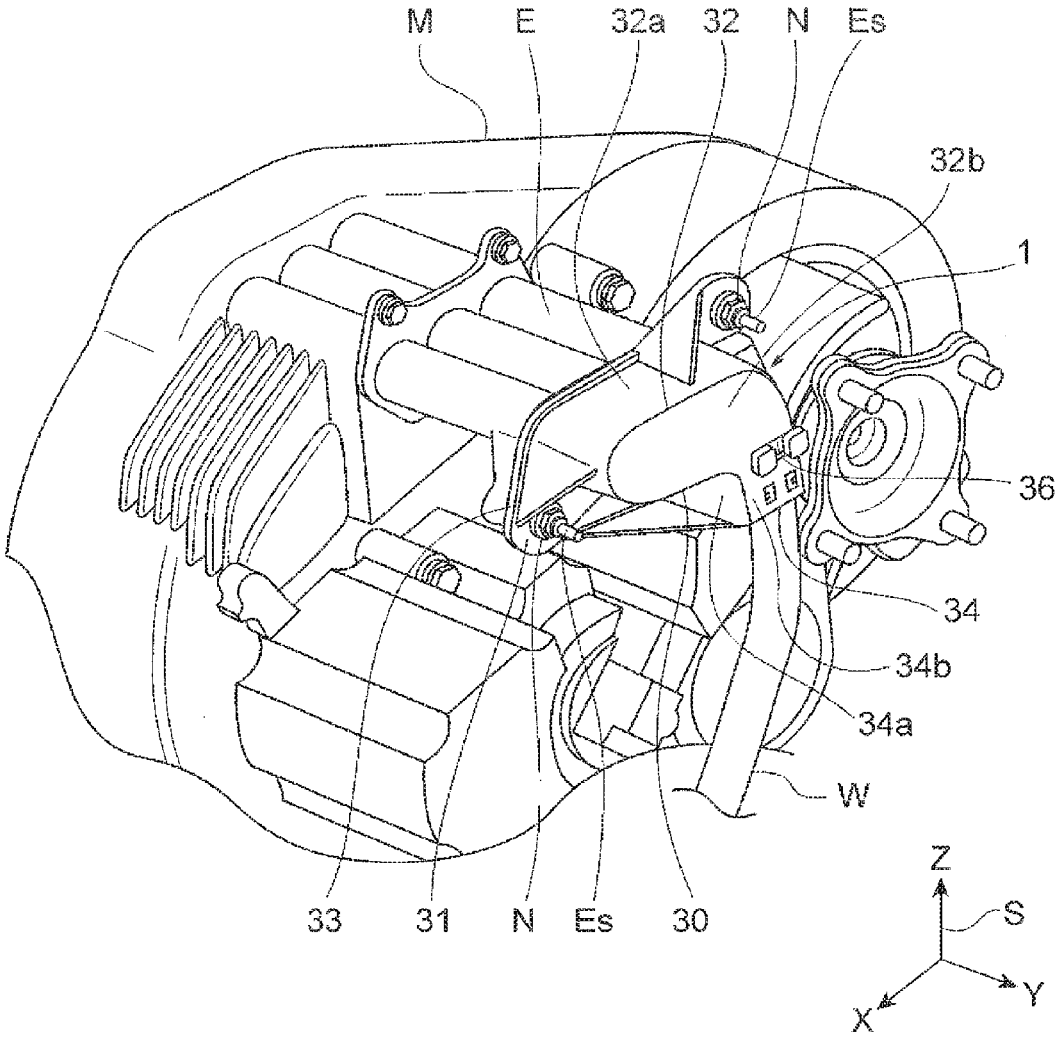
FIG. 1 is a schematic perspective view illustrating a state in which a connector according to the present embodiment is attached to a motor.

Hereinafter, an embodiment of a connector according to an aspect of the present invention will be described in detail with reference to the accompanying drawings. In the description of the drawings, the same constituent elements or the corresponding constituent elements are denoted by the same reference numerals, and the repeated description will not be provided. In some cases, dimensional ratios in each drawing may be different from the actual ones.

Figure 2:
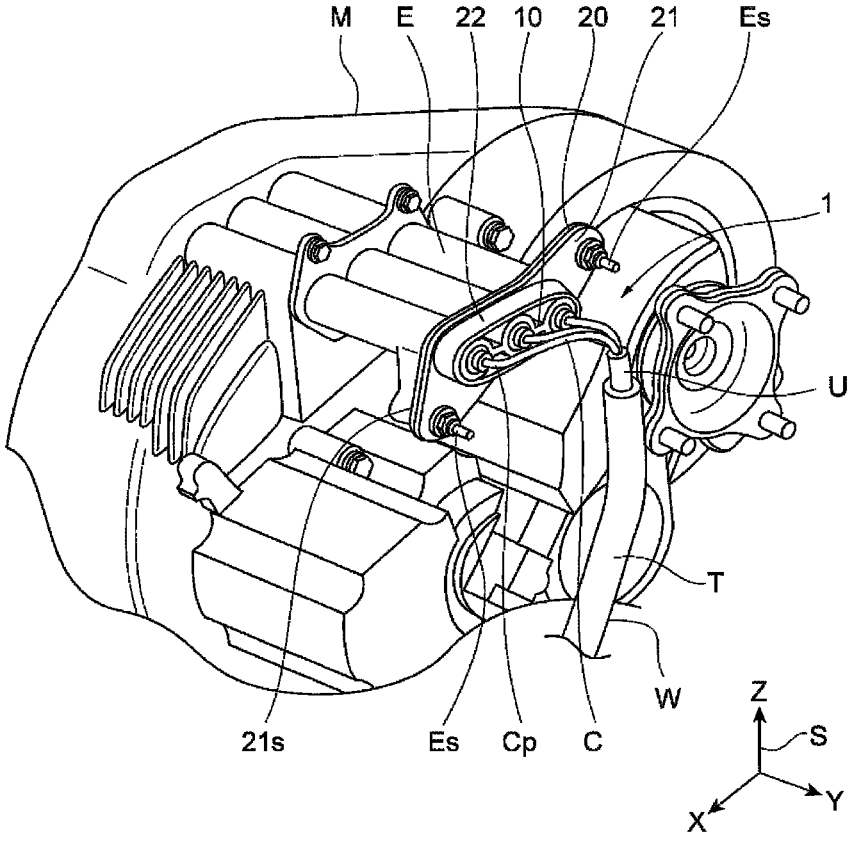
FIG. 2 is a schematic perspective view illustrating a state in which the connector according to the present embodiment is attached to the motor.
Figure 3:
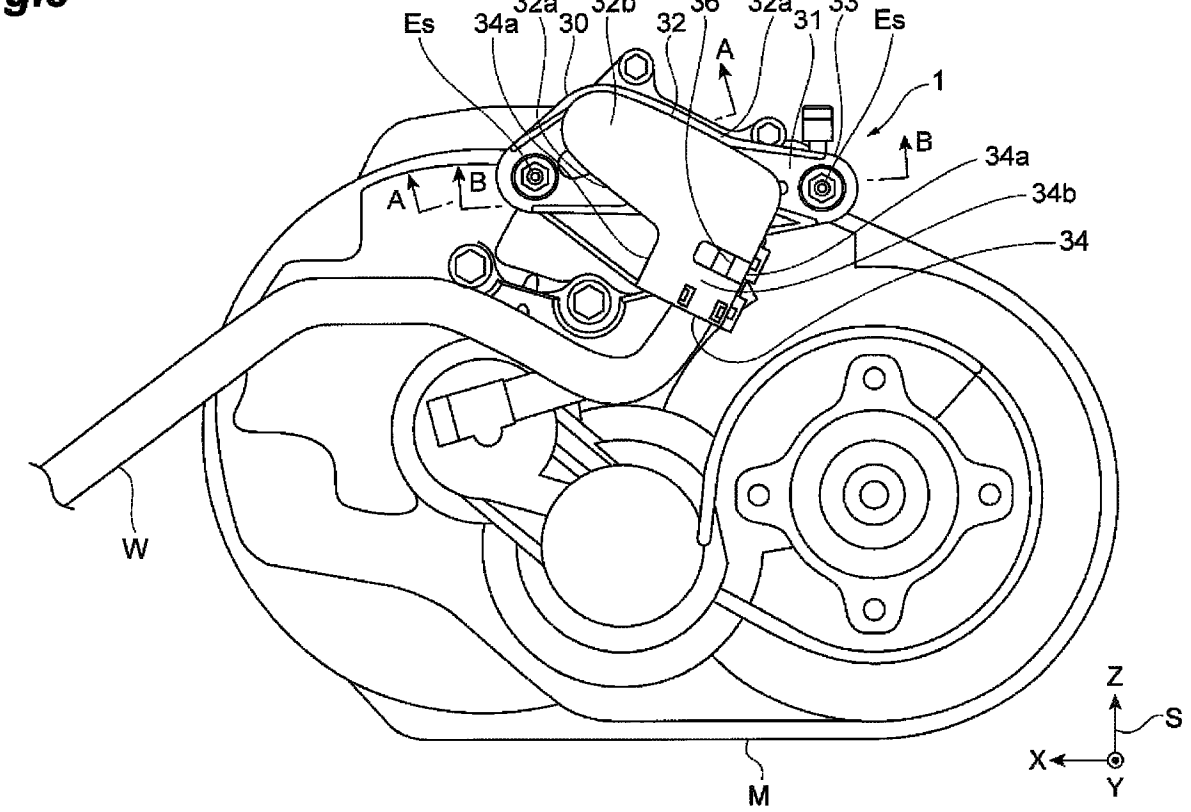
FIG. 3 is a schematic side view illustrating a state in which the connector according to the present embodiment is attached to the motor.
Figure 4B:
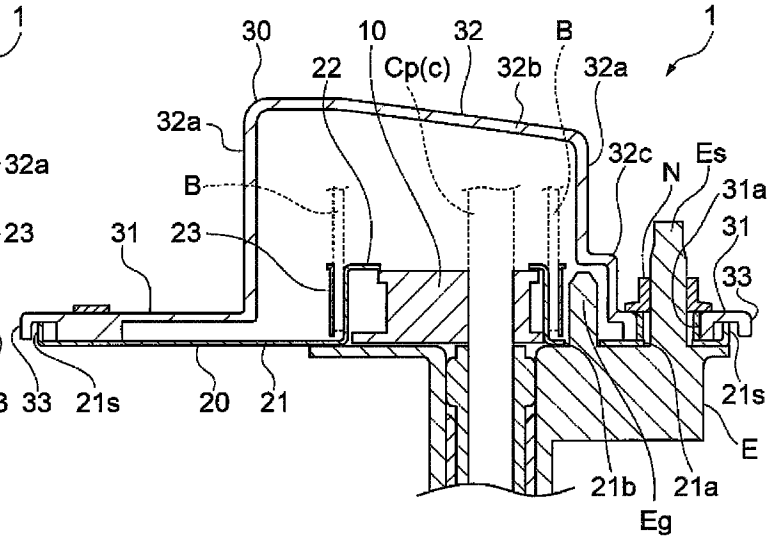
FIG. 4(*a*) and FIG. 4(*b*) are schematic cross-sectional views of the connector illustrated in FIG. 3.
Figure 4A:
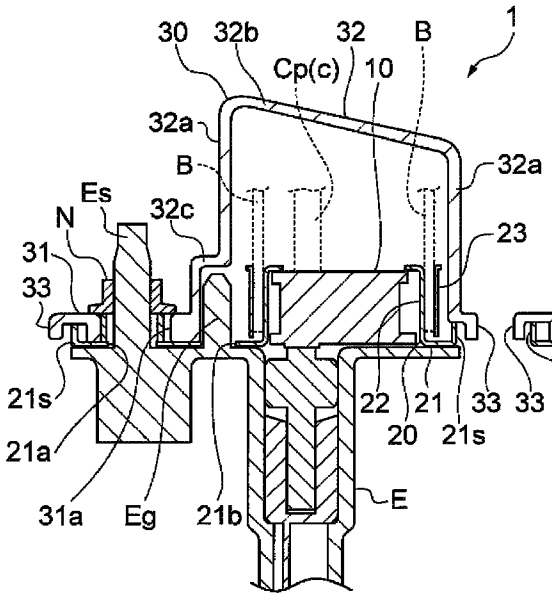

FIGS. 1 and 2 are schematic perspective views illustrating a state in which a connector according to the present embodiment is attached to the motor. In particular, FIG. 1 illustrates a state in which a cover described below is attached, and FIG. 2 illustrates a state in which the cover is detached. FIG. 3 is a schematic side view illustrating a state in which the connector according to the present embodiment is attached to the motor. FIG. 4(*a*) and FIG. 4(*b*) are schematic cross-sectional views of the connector illustrated in FIG. 3. In particular, FIG. 4(*a*) is a schematic cross-sectional view taken along the line A-A of FIG. 3, and FIG. 4(*b*) is a schematic cross-sectional view taken along the line B-B of FIG. 3.

In the following drawings, in some cases, an orthogonal coordinate system S may be illustrated. An X-axis of the orthogonal coordinate system S illustrates a direction toward the front of the vehicle from the rear of the vehicle (a front-back direction of the vehicle). A Y-axis of the orthogonal coordinate system S illustrates direction toward a left side of the vehicle from a right side of the vehicle (a vehicle width direction). A Z-axis of the orthogonal coordinate system S illustrates a direction to the top of vehicle from the bottom of the vehicle (a vertical direction of the vehicle).

A connector 1 illustrated in FIGS. 1, 2, 3, 4(*a*) and 4(*b*) is intended to electrically connect an electric wire C of a wire harness W to a motor M mounted on the vehicle. Here, although the connector 1 is attached to an extension E attached to the motor M, the connector may be directly attached to the motor M. The motor M is, for example, a rear motor of a hybrid vehicle or the like and is a three-phase AC motor as an example.

The wire harness W, for example, electrically connects the motor M and an inverter (not illustrated) to each other. The wire harness W includes a plurality (here, three) of electric wires C, a metallic braided wire B configured to cover the electric wire C, and a corrugated tube (a protective member) T configured to cover the electric wire C and the braided wire B. Further, a plurality of electric wires C may be integrated in the corrugated tube T by being bound with each other through a binding member U.

The connector 1 has a connector main body portion 10 (in particular, see FIG. 2). The connector main body portion 10 is attached to one end portion Cp of the electric wire C exposed from the corrugated tube T. The connector main body portion 10 houses a connector-side terminal (not illustrated). The connector side terminal is electrically connected to a motor-side terminal (not illustrated) of the motor M side through a conductive member (not illustrated) of the extension E. A plurality of electric wires C is electrically connected to the motor-side terminals of the motor M side, via the connector-side terminal in the connector main body portion 10 and the conductive member in the extension E by being inserted into the connector main body portion 10 at one end portion Cp.

The connector 1 has a bracket 20 (in particular, see FIGS. 2, 4(*a*) and 4(*b*)). The bracket 20 is, for example, made of a metal. The bracket 20 includes a bracket base portion 21 and a holding portion 22. The bracket base portion 21 has a flat plate shape. The bracket 20 is fixed to the motor M (here, the extension E) at the bracket base portion 21. For this purpose, the bracket base portion 21 is formed with holes 21*a* and 21*b* through which stud bolts (fixing member) Es and guide pins Eg extending from the extension E are inserted.

The holding portion 22 is provided to protrude from the bracket base portion 21 in a thickness direction (a predetermined direction) of the bracket base portion 21. The holding portion 22 has an elliptical tube shape. The holding portion 22 holds the connector main body portion 10 therein (in other words, the connector main body portion 10 is fitted to the holding portion 22). Thus, the bracket 20 is fixed to the motor M (the extensions E) in the state of holding the connector main body portion 10.

An elliptical annular fixing member 23 is fitted to the holding portion 22 to surround the holding portion 22. The braided wire B of the wire harness W is fixed by being interposed between the outer surface of the holding portion 22 and the inner surface of the fixing member 23 in a state of being exposed from the corrugated tube T. Accordingly, the braided wire B is fixed to the bracket 20 to cover the electric wire C.

Figure 5A:
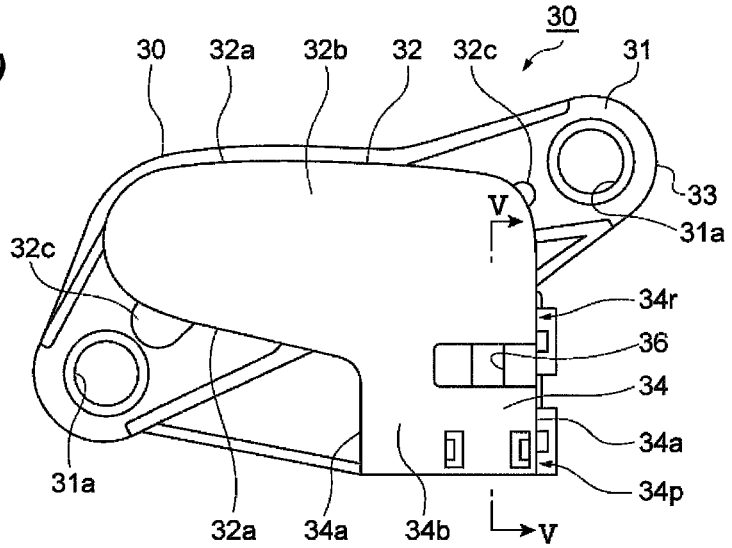
FIG. 5(*a*) and FIG. 5(*b*) are schematic views illustrating a configuration of the cover illustrated in FIG. 1.
Figure 5B:
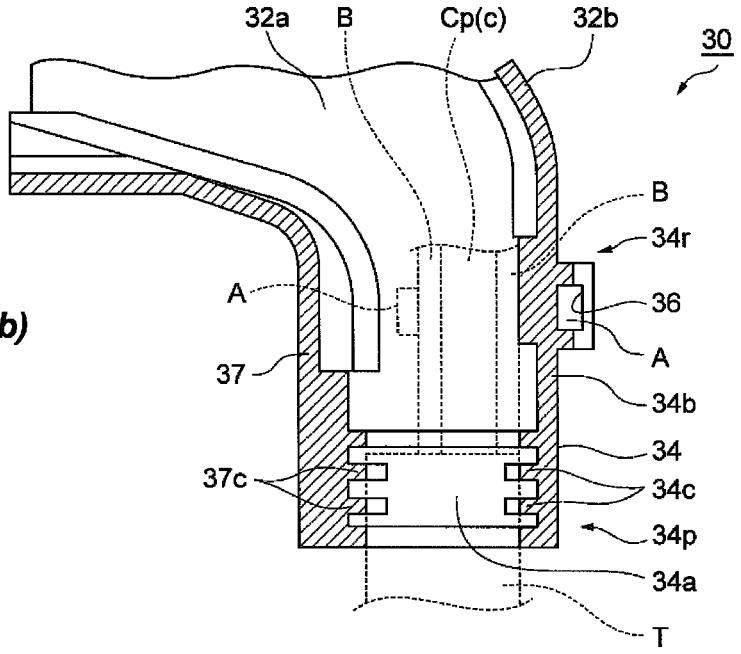
Figure 6:
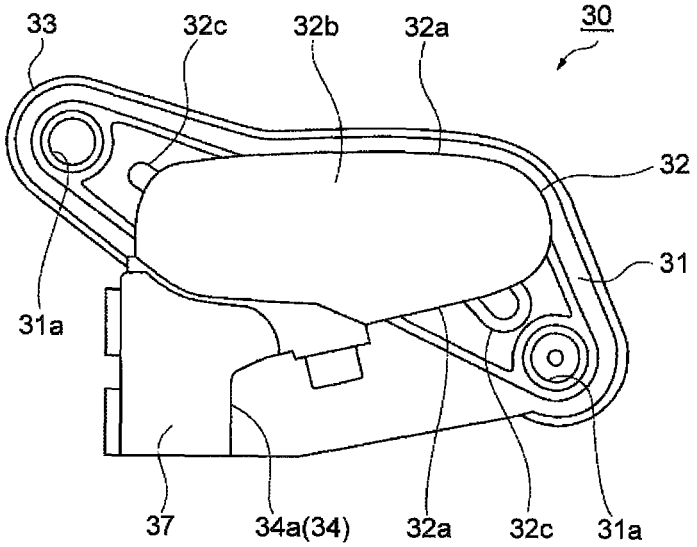
FIG. 6 is a bottom view of the cover illustrated in FIG. 1.
Figure 7:
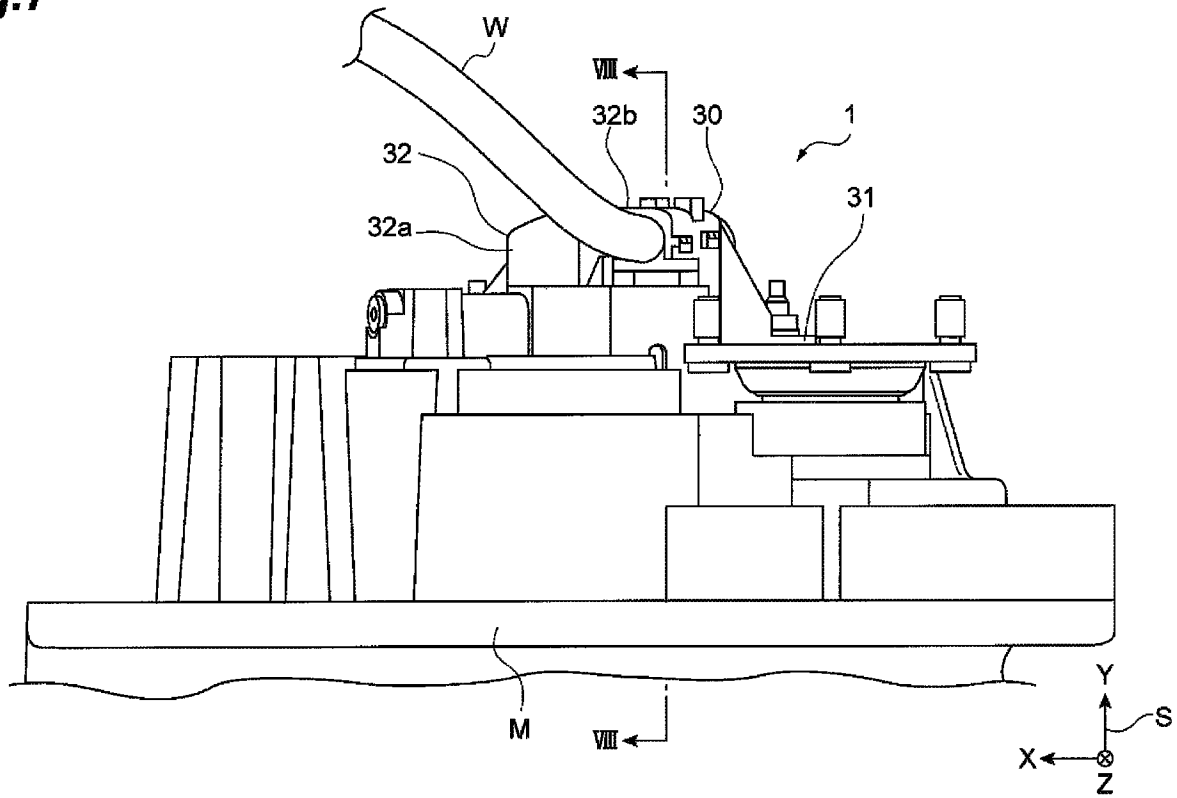
FIG. 7 is a schematic bottom view illustrating a state in which the connector according to the present embodiment is attached to the motor.
Figure 8:
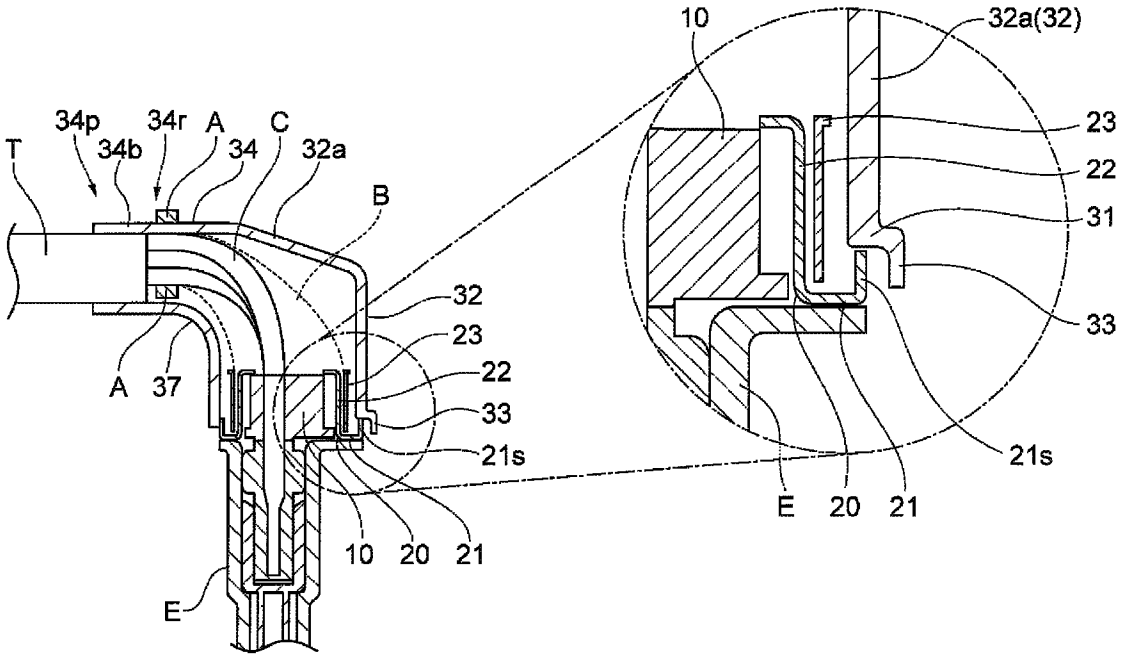
FIG. 8 is a partially cross-sectional view taken along the line VIII-VIII of FIG. 7.

The connector 1 has a cover 30. FIG. 5(*a*) and FIG. 5(*b*) are schematic diagrams illustrating a configuration of the cover illustrated in FIG. 1. In particular, FIG. 5(*a*) is a schematic plan view of the cover, and FIG. 5(*b*) is a partially cross-sectional view taken along the line V-V of FIG. 5(*a*). FIG. 6 is a bottom view of the cover illustrated in FIG. 1. FIG. 7 is a schematic bottom view illustrating a state in which the connector according to the present embodiment is attached to the motor. FIG. 8 is a partially cross-sectional view taken along the line VIII-VIII of FIG. 7.

As illustrated in FIGS. 1, 2, 3, 4(*a*), 4(*b*), 5(*a*), 5(*b*), 6, 7, and 8, the cover 30 is placed over the bracket 20 (more specifically, as described later, the cover 30 is fixed to the motor M together with the bracket 20). The cover 30 includes a cover base portion 31, a cover main body portion 32, a side wall portion 33, a holding portion (a protective member holding portion, and an electric wire holding portion) 34. The cover base portion 31 has a flat plate shape and extends along the bracket base portion 21 in the state in which the cover 30 is placed over the bracket 20. External shapes of the bracket base portion 21 and the cover base portion 31 are substantially the same each other, as viewed from the thickness direction of the bracket base portion 21 and the cover base portion 31.

The cover 30 is fixed to the motor M (the extensions E) in the cover base portion 31. For this purpose, the cover base portion 31 is formed with a hole 31*a* through which the stud bolt Es extending from the extension E is inserted. The cover 30 is fixed to the motor M together with the bracket 20, by screwing a nut (a fixing member) N into the stud bolt Es of the extension E inserted into the holes 21*a* and 31*a*, in the state of making the bracket base portion 21 overlap with the cover base portion 31, while making the hole 31*a* coincide with the hole 21*a* of the bracket base portion 21. That is, the bracket 20 and the cover 30 are fixed to the motor M (the extension E) by a common fixing member (here, the stud bolt Es and the nut N).

The side wall 32*a* of the cover main body portion 32 is provided to protrude from the cover base portion 31 in the thickness direction (the protruding direction of the holding portion 22: a predetermined direction) of the cover base portion 31. The cover main body portion 32 is formed in an elliptical box shape that opens to the cover base portion 31, by elliptical annular side walls 32*a* extending in the thickness direction of the cover base portion 31, and an upper wall 32*b* extending along the cover base portion 31 so as to be stretched between the side walls 32*a*. The cover main body portion 32 covers (houses) the holding portion 22, the connector main body portion 10, the one end portion Cp of the electric wire C and the one end portion of the braided wire B, in the state in which the cover 30 is placed over the bracket 20.

Further, the cover main body portion 32 is provided with a protruding portion 32*c* and the guide pin Eg extending from the extension E is disposed in the protruding portion 32*c* when the cover 30 is fixed to the extension E together with the bracket 20. That is, when the cover 30 is fixed to the extension E together with the bracket 20, the guide pin Eg is covered (housed) with the cover main body portion 32 (the protruding portion 32*c*).

The side wall portion 33 is provided along the outer edge of the cover base portion 31 (in particular, see FIGS. 4(*a*), 4(*b*), and 8). The side wall portion 33 protrudes from the cover base portion 31 in a direction opposite to the protruding direction of the holding portion 22 and the cover main body portion 32. The side wall portion 33 is located outside the outer surface 21*s* of the bracket base portion 21. Further, the side wall portion 33 overlaps (wraps) the outer surface 21*s* of the bracket base portion 21 as viewed from a direction intersecting with the protruding direction of the holding portion 22 and the cover main body portion 32.

The holding portion 34 extends from the cover main body portion 32 (in particular, see FIGS. 5(*a*), 5(*b*), and 6). More specifically, the holding portion 34 is formed to have a U-shaped cross-section by a pair of side walls 34*a* extending from the side wall 32*a* of the cover main body portion 32 and an upper wall 34*b* extending from the upper wall 32*b* of the cover main body portion 32 so as to be stretched between the side walls 34*a*. A plurality of projections (rasp-cuts) 34*c* is formed on an inner surface (an inner surface of the upper wall 34*b*) of the end portion 34*p* of the holding portion 34, on the side opposite to the cover main body portion 32.

A plate-shaped lid member 37 is attached to the holding portion 34 so as to be close to the opening portion of the holding portion 34 defined by a pair of side walls 34*a*. A plurality of projections (rasp-cuts) 37*c* is formed on the inner surface of the lid member 37. Thus, by attaching the lid member 37 to the holding portion 34 in a state of disposing the corrugated tube T on the inner surface of the end portion 34*p* of the holding portion 34, and by at least bringing (in some cases, by biting) the plurality of projections 34*c* and 37*c* into contact with the corrugated tube T, the corrugated tube T can be held on the end portion 34*p*. That is, the cover 30 includes a protective member holding portion (the holding portion 34 (the end portion 34*p*)) configured to hold the corrugated tube T for covering the electric wire C.

Further, on the outer surface (the outer surface of the side wall 34*a*) of an intermediate portion 34*r* between the end portion 34*p* of the holding portion 34 and the cover main body portion 32, a hole 36 through which the binding band (a tie-band) A is inserted is formed. Thus, by disposing the electric wire C and braided wire B exposed from the corrugated tube T on the inner surface of the intermediate portion 34*r*, and by binding the electric wires C and the braided wire B together with the side walls 34*a* through the binding band A inserted through the hole 36, the electric wire C and the braided wire B can be held on the intermediate portion 34*r*. At this time, a plurality of electric wires C is bound into one piece.

That is, the cover 30 includes an electric wire holding portion (the holding portion 34 (the intermediate portion 34*r*)) that holds the electric wire C of the state of being exposed from the corrugated tube T. In this way, the cover 30 is placed over the bracket 20 so as to cover the connector main body portion 10 in the state of holding the electric wire C, the braided wire B and the corrugated tube T, and is fixed to the motor M (the extension E). Thus, the electric wire C, the braided wire B and the corrugated tube T are fixed to the motor M.

As described above, in the connector 1 according to this embodiment, the connector main body portion 10 is attached to one end portion Cp of the electric wire C and is held on the bracket 20. The bracket 20 is fixed to the motor M in the state of holding the connector main body portion 10. Further, the cover 30 is placed over the bracket 20 to cover the connector main body portion 10 held by the bracket 20. Therefore, the connector main body portion 10 is suppressed from flooding. Meanwhile, the cover 30 is fixed to the motor M in the state of holding the electric wire C. Therefore, an occurrence of the bending and stretching in the electric wire caused by the independent vibration of the motor M and the electric wire C is avoided. Thus, according to the connector 1, the reliability is improved.

Further, in the connector 1 according to the present embodiment, the cover 30 is placed over the bracket 20 so as to further cover the metallic braided wire B that is fixed to the bracket 20 to cover the electric wire C. That is, in the connector 1, the braided wire B configured to cover the electric wire C is further covered with the cover 30. Therefore, it is possible to shield the noise from the motor M by the braided wire B while suppressing the braided wire B from being rusted due to flooding.

Further, in the connector 1 according to the present embodiment, the cover 30 includes the protective member holding portion (the holding portion 34 (the end portion 34*p*)) that holds the corrugated tube T for covering the electric wire C, and an electric wire holding portion (the holding portion 34 (the intermediate portion 34*r*)) that holds the electric wire C of the state of being exposed from the corrugated tube T. Therefore, along with the fixation of the cover 30 to the motor M, upon the fixation of the electric wire C to the motor M, the corrugated tube T which covers the electric wire C is also fixed to the motor M. Therefore, it is possible to suppress the abrasion from occurring in the electric wire C and the corrugated tube T, due to the independent vibration of the corrugated tube T and the electric wire C.

Further, in the connector 1 according to the present embodiment, the bracket 20 and the cover 30 are fixed to the motor M the extension E) by a common fixing member (the stud bolt Es and the nut N of the extension E). Thus, upon the improvement in reliability of the connector 1, it is possible to simplify the structure and reduce the number of components. Further, it is possible to save the space.

Further, in the connector 1 according to the present embodiment, the side wall portion 33 protruding from the outer edge of the cover base portion 31 overlaps the outer surface 21*s* on the outer side than the outer surface 21*s* of the bracket base portion 21. Therefore, it is possible to suppress water from entering the bracket from the outer surface 21*s* of the bracket base portion 21.

The above-described embodiment illustrates an embodiment of the connector according to an aspect of the present invention. Thus, the connector according to an aspect of the present invention is not limited to the above-described connector 1. The connector according to an aspect of the present invention can be obtained by arbitrarily deforming the above-described connector 1 within the scope that does not depart from the gist of the claims.

For example, in the above-described embodiment, the description has been given of a case where the bracket 20 and the cover 30 are fixed to the motor M (the extension E) using the common fixing member (the stud bolt Es and the nut N). However, the bracket 20 and the cover 30 may be independently fixed to the motor M (the extension E) using the fixing members different from each other.

INDUSTRIAL APPLICABILITY

According to an aspect of the present invention, it is possible to provide a connector capable of improving the reliability.

REFERENCE SIGNS LIST

1 Connector
10 Connector main body portion
20 Bracket
21 Bracket base portion
21*s* Outer surface
22 Holding portion
30 Cover
31 Cover base portion
32 Cover main body portion
33 Side wall portion
34 Holding portion (protective member holding portion, electric wire holding portion)
M Motor
C Electric wire
B Braided wire
Es Stud bolt (fixing member)
N Nut (fixing member)

The invention claimed is:

1. A connector configured to electrically connect an electric wire to a motor mounted on a vehicle, the connector comprising:

a connector main body portion attached to one end portion of the electric wire;

a bracket fixed to the motor in a state of holding the connector main body portion; and a cover placed over the bracket so as to cover the connector main body portion and fixed to the motor in a state of holding the electric wire.

2. The connector according to claim 1, wherein the cover is placed over the bracket so as to further cover a metallic braided wire fixed to the bracket so as to cover the electric wire.

3. The connector according to claim 1, wherein the cover includes a protective member holding portion configured to hold a protective member covering the electric wire, and an electric wire holding portion configured to hold the electric wire of a state of being exposed from the protective member.

4. The connector according to claim 1, wherein the bracket and the cover are fixed to the motor by a common fixing member.

5. The connector according to claim 1, wherein the bracket includes a flat plate-like bracket base portion, and a holding portion provided to protrude from a bracket base portion in a predetermined direction and configured to hold the connector main body portion, the cover includes a cover base portion extending along the bracket base portion, a cover main body portion provided to protrude from the cover base portion in a predetermined direction and configured to cover the connector main body portion and the holding portion, and a side wall portion provided to protrude from an outer edge of the cover base portion in a direction opposite to the predetermined direction, and the side wall portion is located outside an outer surface of the bracket base portion and overlaps the outer surface of the bracket base portion when viewed from a direction intersecting with the predetermined direction.

* * * * *